US005203264A

United States Patent [19]

Sodder, Jr.

[11] Patent Number: 5,203,264

[45] Date of Patent: Apr. 20, 1993

[54] RE-RAILING UNIT FOR DERAILED RAIL CAR

[76] Inventor: George Sodder, Jr., 51 Maple St., Falls View, W. Va.

[21] Appl. No.: 779,336

[22] Filed: Oct. 18, 1991

[51] Int. Cl.[5] ..... B61F 9/00

[52] U.S. Cl. ..... 104/263; 104/273

[58] Field of Search ..... 104/262, 263, 264, 265, 104/266, 273; 254/84, 85, 35, 34, 89 H

[56] References Cited

U.S. PATENT DOCUMENTS

| | | | |
|---|---|---|---|
| 1,131,018 | 3/1915 | Troutman | 254/85 |
| 3,085,785 | 4/1963 | Peterson | 254/89 H |
| 3,362,351 | 1/1968 | Robertson | 254/84 |
| 3,588,046 | 6/1971 | Weaver | 254/85 |
| 3,828,689 | 8/1974 | Raffenberg | 104/262 |
| 4,068,823 | 1/1978 | Belanger | 254/89 H |
| 4,089,426 | 5/1978 | Sheppard | 265/85 |
| 4,090,453 | 5/1978 | Ali et al. | 104/273 |
| 4,809,615 | 3/1989 | Brickett | 104/266 |
| 4,825,771 | 5/1989 | du Preez et al. | 254/84 |

FOREIGN PATENT DOCUMENTS

| | | | |
|---|---|---|---|
| 3403857 | 8/1985 | Fed. Rep. of Germany | 256/85 |
| 0931696 | 6/1982 | U.S.S.R. | 254/84 |
| 0882491 | 11/1961 | United Kingdom | 104/266 |

*Primary Examiner*—Mark T. Le

*Attorney, Agent, or Firm*—Burns, Doane, Swecker & Mathis

[57] ABSTRACT

A re-railing unit for re-railing a derailed rail car comprises a base, two stabilizer rams located at opposite ends of the base, and a port plate slidably mounted on the base. The support plate carries a pair of vertical lifting rams from which is suspended a vertical lifting arm. The bottom of the lifting arm is hook-shaped to engage the underside of a rail car drawhead. The lifting arm raises an end of the rail car in response to extension of the lifting rams. A shifting ram then slides the support plate across the base to reposition the rail car wheels over the track. The lifting arm is lowered to enable the wheels to rest upon the track.

5 Claims, 7 Drawing Sheets

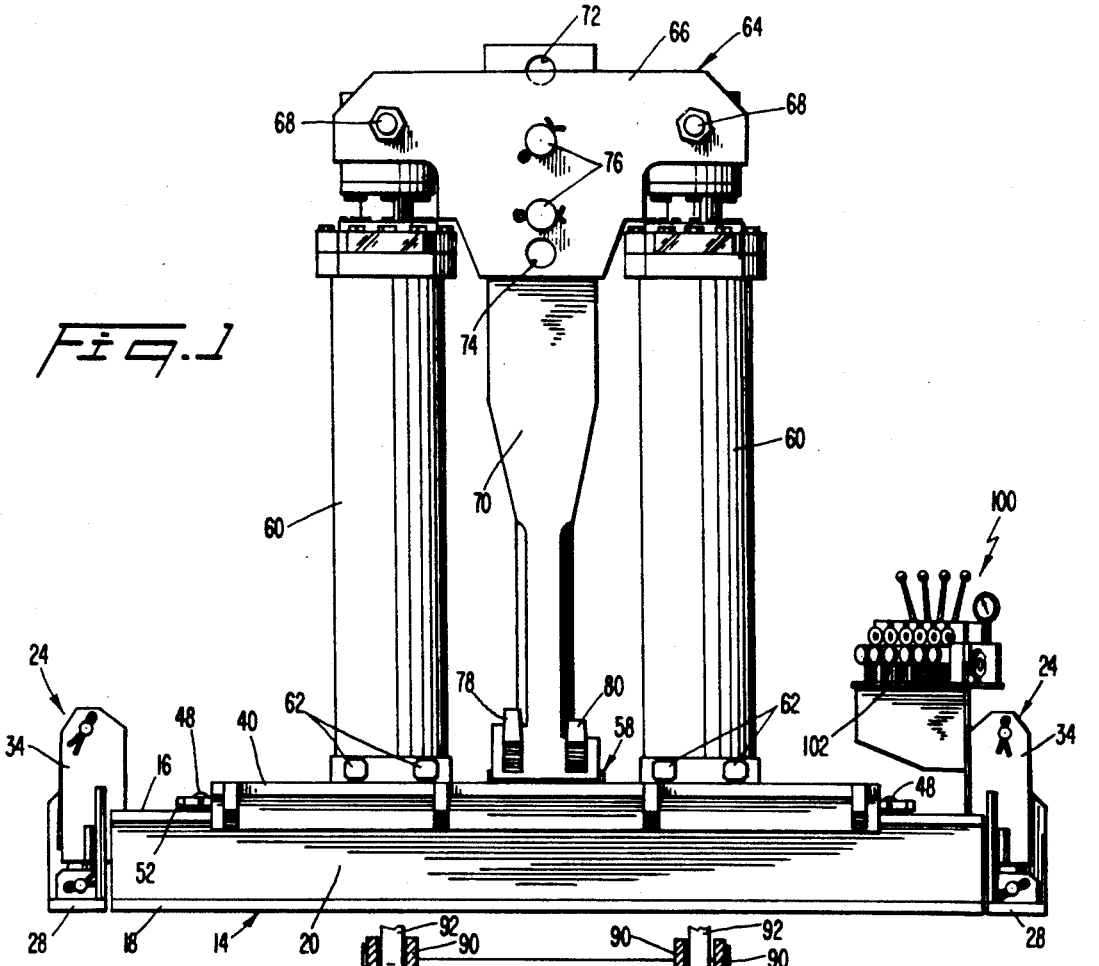
Fig. 1
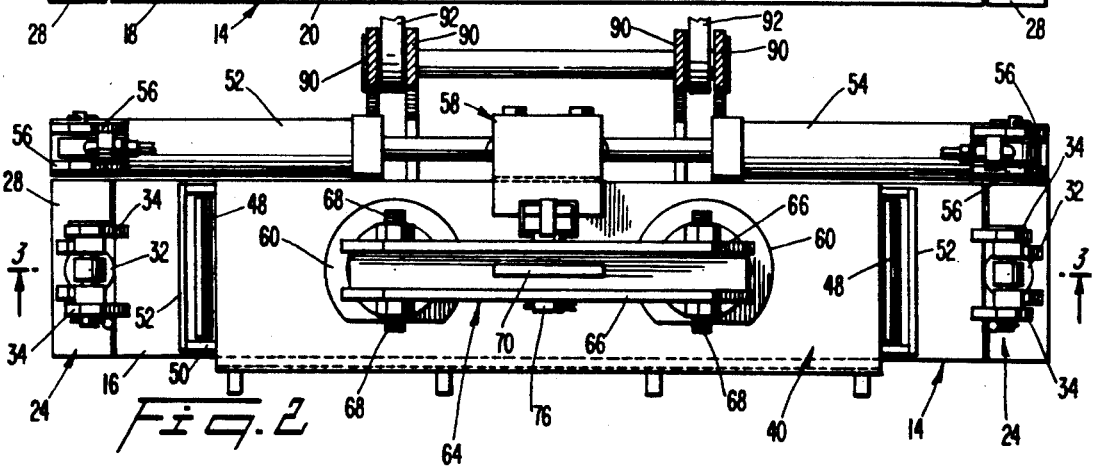
Fig. 2
Fig. 3
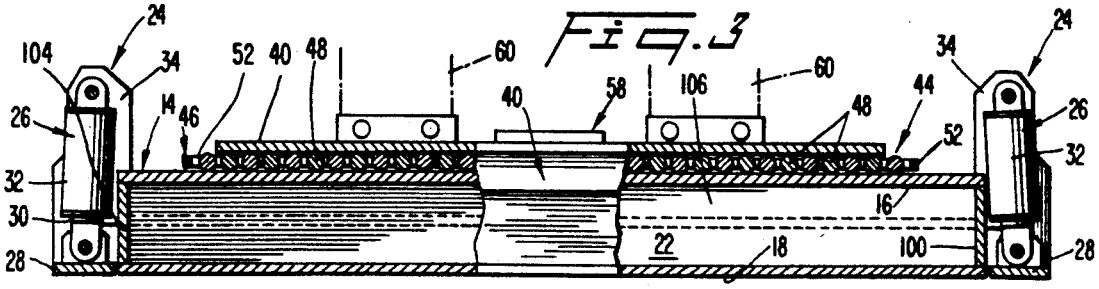

RE-RAILING UNIT FOR DERAILED RAIL CAR

BACKGROUND OF THE INVENTION

The present application relates to a re-railer apparatus for placing de-railed railroad cars back onto a track.

The accidental de-railing of railroad cars during normal movement of the cars at a railroad yard and the like is not uncommon. When this occurs, it has been heretofore necessary to dispatch to the derailing site a track-mounted crane car which is able to re-rail the car by picking-up the de-railed end(s) of the ca nd returning it to the track. Such crane cars are quite costly, as a result of which there are only a limited number of such crane cars available. Hence, the crane car may not be located near the de-railing site, so a considerable delay could occur before the crane car arrives. Also, the cost of the services of such a crane car is normally quite high.

It would, therefore, be desirable to provide a less expensive apparatus for re-railing a de-railed railroad car, the apparatus being of relatively small size and easily transportable by conventional vehicles.

SUMMARY OF THE INVENTION

The present invention relates to a re-railing unit for re-railing a de-railed rail car. The re-railing unit comprises a base having longitudinally spaced ends and ground supports. A support plate is mounted on the base for longitudinal sliding movement relative thereto. A lifting arm is mounted on the support plate and includes a contacting structure for making contact with a draw head of the de-railed rail car. A first power mechanism is mounted on the support plate and is operably connected to the lifting arm for raising the lifting arm and an end of a rail car. A second power mechanism is provided for sliding the support plate generally horizontally relative to the base for repositioning the wheels of the raised rail car over the rails of a track, whereupon the fist power mechanism is operable to lower the wheels onto the track rails.

Preferably, the ground supports comprise two vertically adjustable stabilizer arms mounted on the base opposite its ends.

A bearing device is preferably disposed between the support plate and the base, the bearing device comprising a plurality of rolling elements mounted to a retainer which is freely movably disposed between the support plate and the base.

BRIEF DESCRIPTION OF THE DRAWINGS

The objects and advantages of the invention will become apparent from the following detailed description of a preferred embodiment thereof in connection with the accompanying drawings, in which like numerals designate like elements, and in which:

FIG. 1 is a front elevational view of a re-railer unit according to the present invention, with a lifting arm thereof in a lowered position;

FIG. 2 is a plan view of the re-railer unit depicted in FIG. 1 with a support plate thereof in a horizontally centered position;

FIG. 3 is a vertical sectional view taken along the line 3—3 in FIG. 2;

DETAILED DESCRIPTION OF A PREFERRED EMBODIMENT OF THE INVENTION

Figure 6:
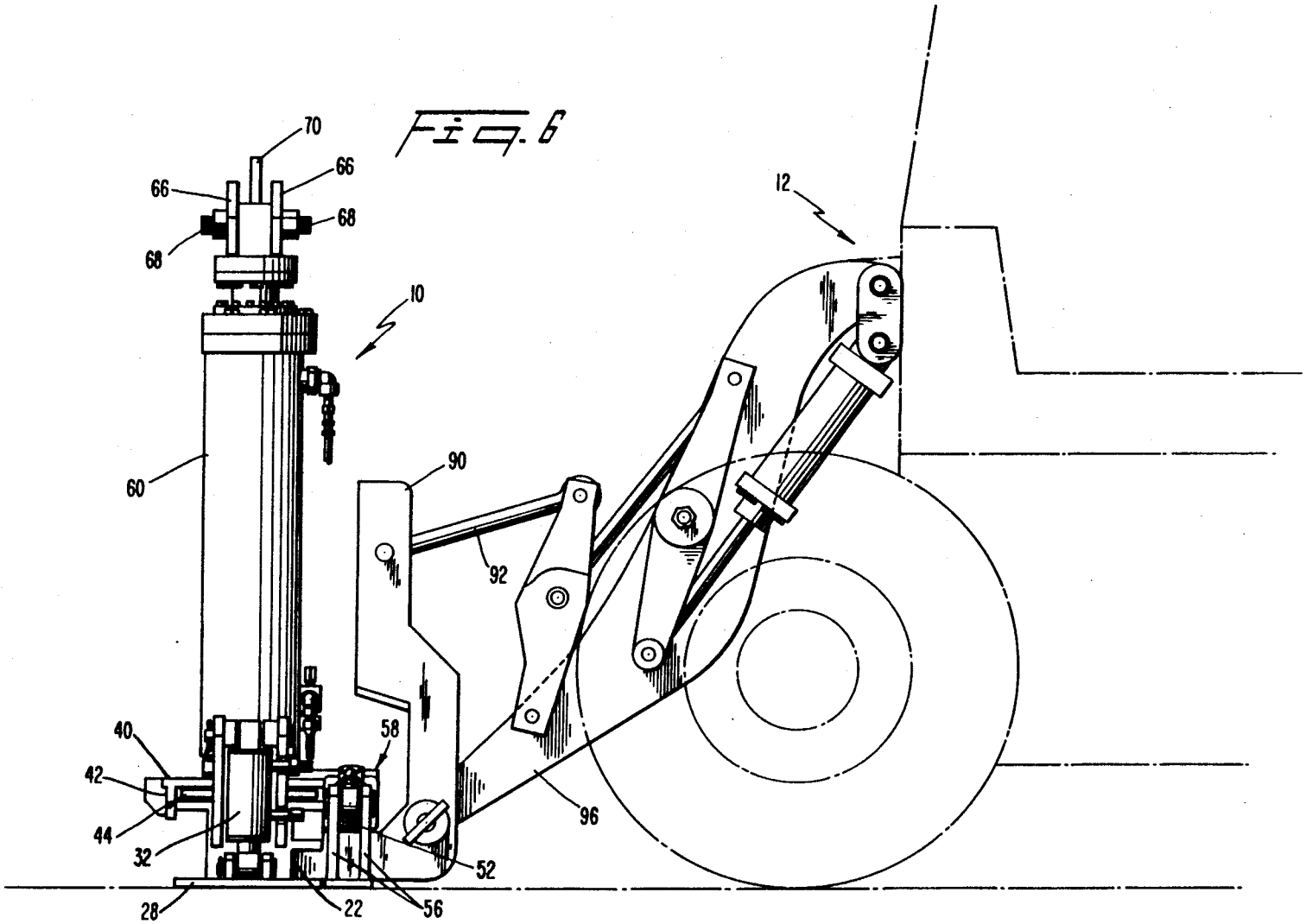
FIG. 6 is an end elevational view of the re-railing unit and a portion of a vehicle to which it is connected, with the re-railing unit in a lowered position.
Figure 7:
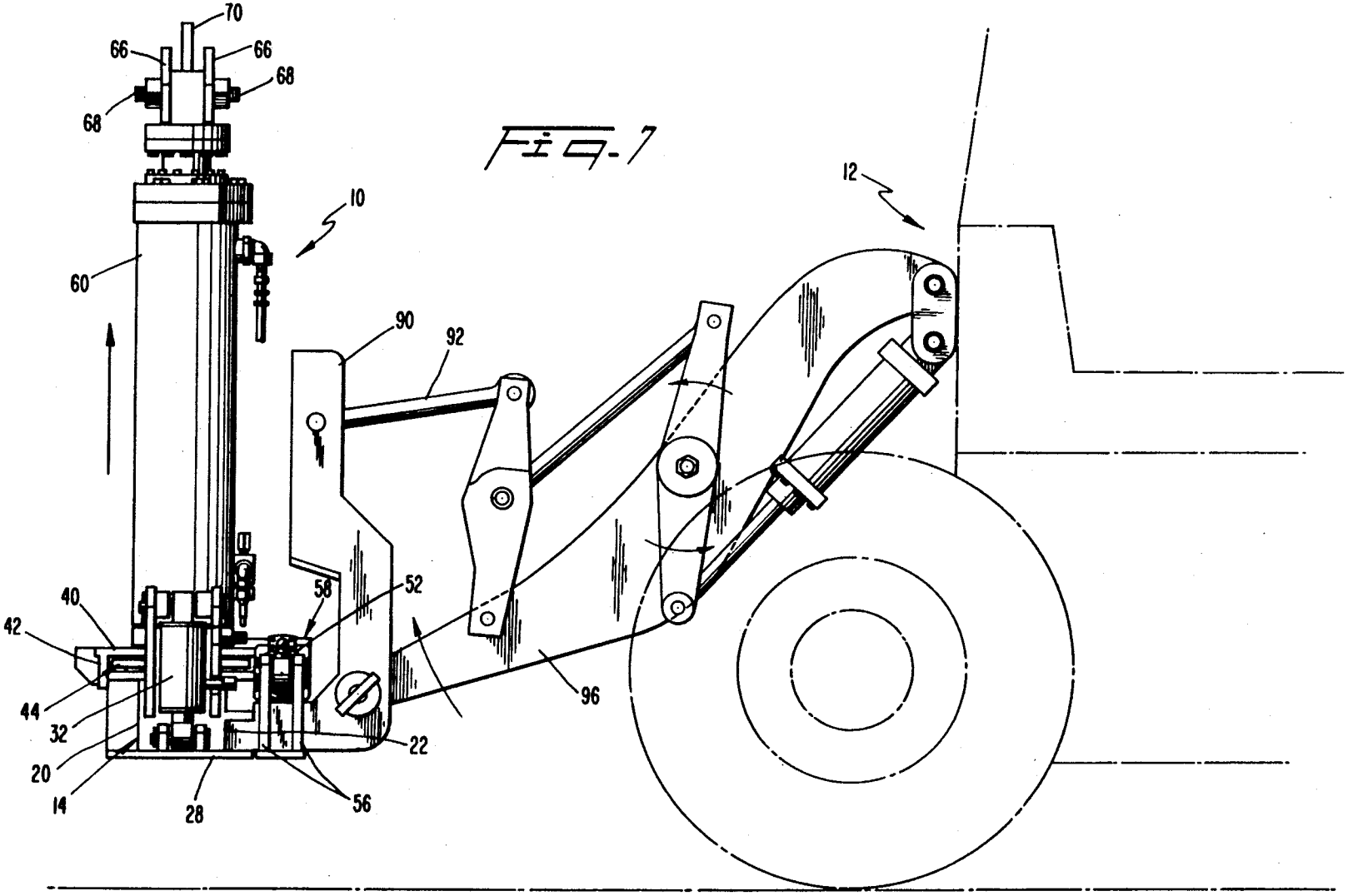
FIG. 7 is a view similar to FIG. 6 after the re-railing unit has been raised by the vehicle.

A re-railing apparatus 10 is depicted in the accompanying drawings as being attached to a conventional vehicle 12 such as a front end loader (see FIG. 6). The vehicle 12 functions to transport the re-railer 10 to a de-railing site, but may or may not perform any functions during the re-railing operation itself, as will become clear from the following.

The re-railer 10 comprises a base in the form of a horizontal box H-beam (e.g., see FIGS. 1 and 6) having upper and lower horizontal flanges 16, 18 interconnected by two vertical flanges 20, 22. Mounted at opposite ends of the beam 14 are two identical ground supports in the form of stabilizer jacks 24. Each stabilizer jack comprises a hydraulic ram 26 and a plate 28 pivotably mounted to a lower end of a piston rod 30 of that ram. A cylinder part 32 of the ram 26 is pivotably mounted at its upper end to brackets 34 which are fixed to the beam 14.

The stabilizer jacks 24 are independently actuable so as to be able to horizontally position the beam 14 relative to horizontal.

Mounted atop the beam 24 is a support plate 40 which is adapted to slide longitudinally (i.e., left-to-right in FIG. 1) along the upper flange 16 of that beam. The support plate 40 carries along its longitudinal edges a pair of downwardly projecting, parallel skirt members 42 which straddle the upper flange 16 in order to prevent the support plate from sliding laterally off the beam.

Figures 4, 5:
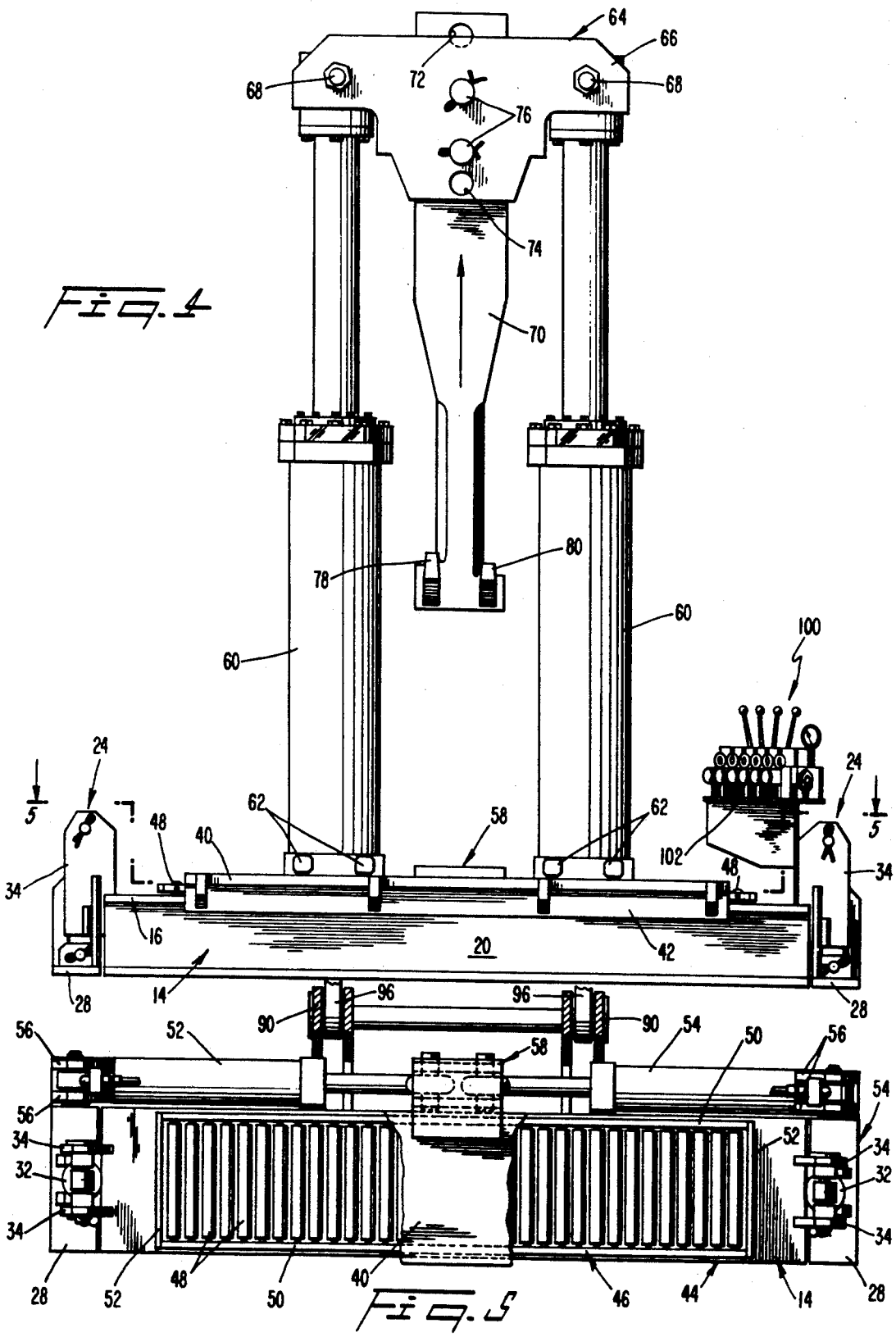
FIG. 4 is a view similar to FIG. 1 after the lifting arm has been raised.
FIG. 5 is a horizontal sectional view taken along the line 5—5 in FIG. 4.

In order to facilitate the longitudinal sliding movement of the support plate 40, a bearing unit 44 (see FIGS. 3, 5) is disposed between the support plate 40 and a top face of the upper flange 16. That bearing unit 44 comprises a rectangular retainer 46 in which a plurality of rollers 48 are freely rotatably mounted for rotation about axes oriented laterally of the longitudinal direction of the beam 14. The retainer comprises a pair of parallel side bars 50 interconnected by a pair of parallel end bars 52. The rollers 48 have axles which are rotatably mounted in opposing holes formed in the side bars 50.

The bearing unit 44 is freely movably disposed between the support plate 40 and the upper flange 16 of the beam 14.

Two hydraulic shifter rams 52, 54 (see FIG. 2) are provided for sliding the support plate 40 relative to the H-beam 14. Each shifter ram 52, 54 is horizontally oriented and has its cylinder part pivotably mounted to a pair of brackets 56 fixed to the beam 14. The piston rod end of each shifter ram is pivotably mounted to a bracket 58 which is fixed to the support plate 40 Hence, by extending one of the shifter rams 52, 54 while retracting the other, the support plate 40 is caused to slide horizontally along the beam 14.

Mounted on the support plate 40 are two hydraulic ram 60. The lower, cylinder ends of the lifter rams are fixedly mounted to the support plate, e.g., by bolts 62, and the lifter rams 60 extend vertically therefrom. The upper, rod ends of the lifter rams 60 are pivotably connected to opposite ends of a carrier member 64. The carrier member comprises two generally T-shaped plates 66 which are parallel and horizontally spaced apart (see FIGS. 1 and 2). A pair of bolts 68 interconnect the opposite ends of the plates 66, and the rod ends of the lifter rams are disposed within a space disposed between the plates and are pivotably connected to those bolts 68.

Figure 8:
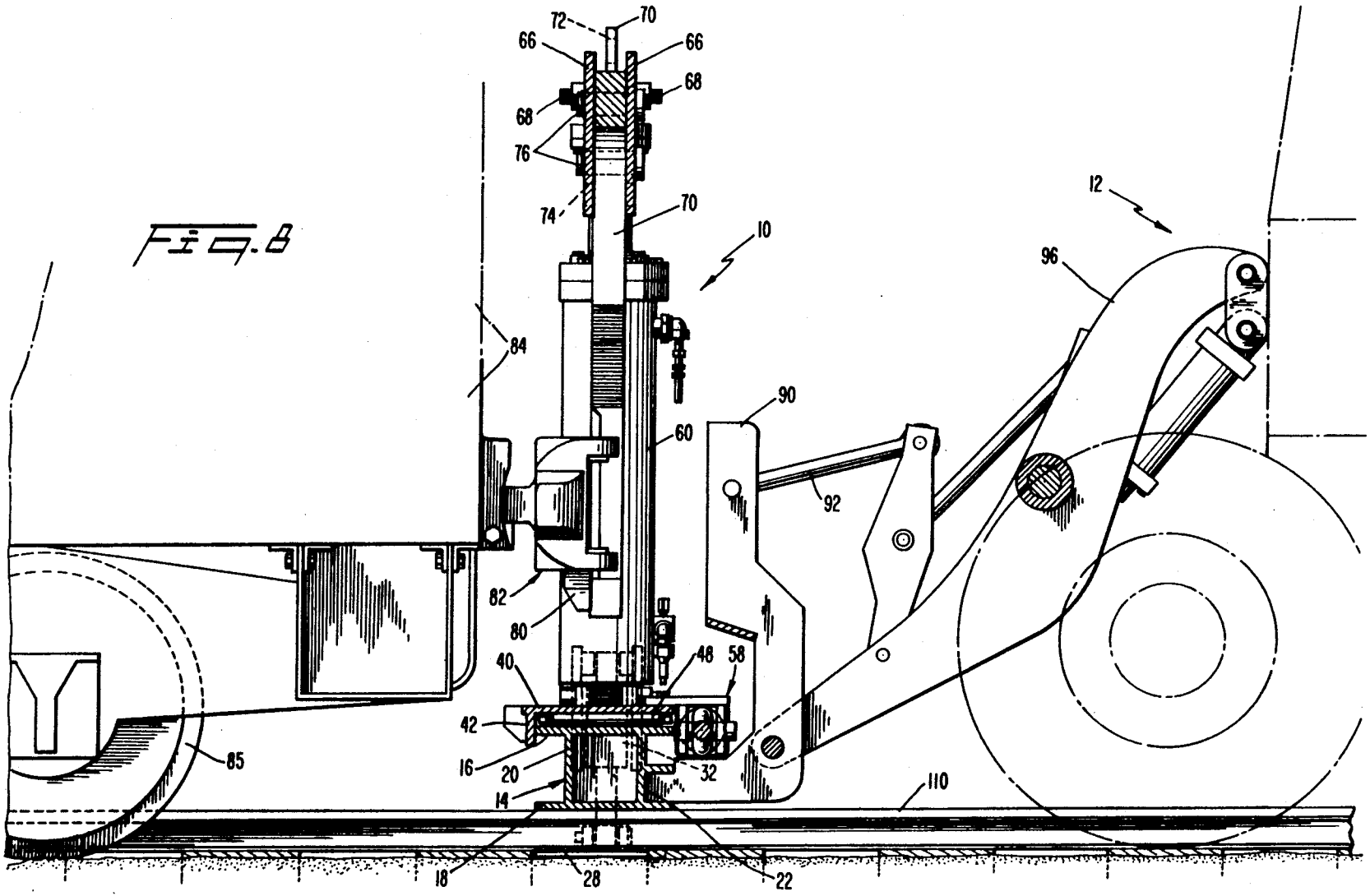
FIG. 8 is a vertical sectional view through the re-railing unit with the re-railing unit positioned in front of a de-railed rail car.

Also disposed within that space is the upper end of a vertical lifter ram 70. That lifter arm 70 contains a plurality of vertically spaced holes 72 which are alignable with holes 74 formed in the plates 66. Pins 76 are insertable through the holes 72, 74 to hold the lifter arm in vertical positions of adjustment. The lower end of the lifter arm 70 carries a pair of hook-shaped lugs 78, 80 which are configured to grip the underside of a standard drawhead 82 (FIG. 8) projecting from the ends of a conventional railroad car 84.

Connected to a rear side of the beam are two pairs of upstanding connector arms 90 which are adapted to be connected to a vehicle, such as the front end loader 12. Each connector arm 90 includes upper and lower mounts for connection with appropriate links 92, 96 of the front end loader 12. By suitable operation of the vehicle links, the re-railer 10 can be picked up and transported (see FIG. 8).

Disposed adjacent one end of the beam is a control mechanism 100 (FIG. 1) mounted on a platform 102 which, in turn, is affixed to the beam 14. The control mechanism includes conventional manually actuated hydraulic valves for selectively directing the pressurized hydraulic fluid to the various hydraulic rams 32, 52, 54, 60.

The source of pressurized hydraulic fluid may be provided by the vehicle 12, or by the re-railer 10 itself. In the former case, the vehicle should possess a conventional system which includes a supply of hydraulic fluid, a pump for pressurizing the fluid, and a valve for connecting the pump to external equipment. By connecting the vehicle pump to the control mechanism, the hydraulic rams of the re-railer can be operated by the vehicle hydraulics.

Alternatively, and as noted earlier, the pressurized hydraulic fluid could be supplied by the re-railer 10 itself. This can be achieved by forming a chamber within the beam (e.g., by welding plates 104 (see FIG. 3) onto the end of the beam 14 so that the beam forms an internal chamber 106 bordered by the upper and lower flanges 16, 18, the two vertical flanges 22, and the end plates 104. By means of suitable fittings, hydraulic fluid an be supplied to, and removed from, such a chamber 106. A pump would be mounted on the beam 14, preferably near the control mechanism, and would be connected to the chamber 106 for pressurizing the hydraulic fluid. That means that the vehicle 12 would be needed only to transport the re-railer and could be used for other functions as the re-railer performs a re-railing operation.

In practice, when there occurs the de-railing of a rail car 84, such as a freight car, locomotive, tanker car, caboose, etc., the re-railer unit 10 is attached to the vehicle 12 and transported to the de-railing site. If the de-railing has occurred in a rail yard, as is not uncommon, it is likely that a vehicle such as the front end loader 12 is in the vicinity and can be obtained relatively soon. Thus, if the rail yard keeps on and a re-railing unit 10, the unit can be quickly positioned in front of the de-railed end of the rail car 84.

Figure 9:
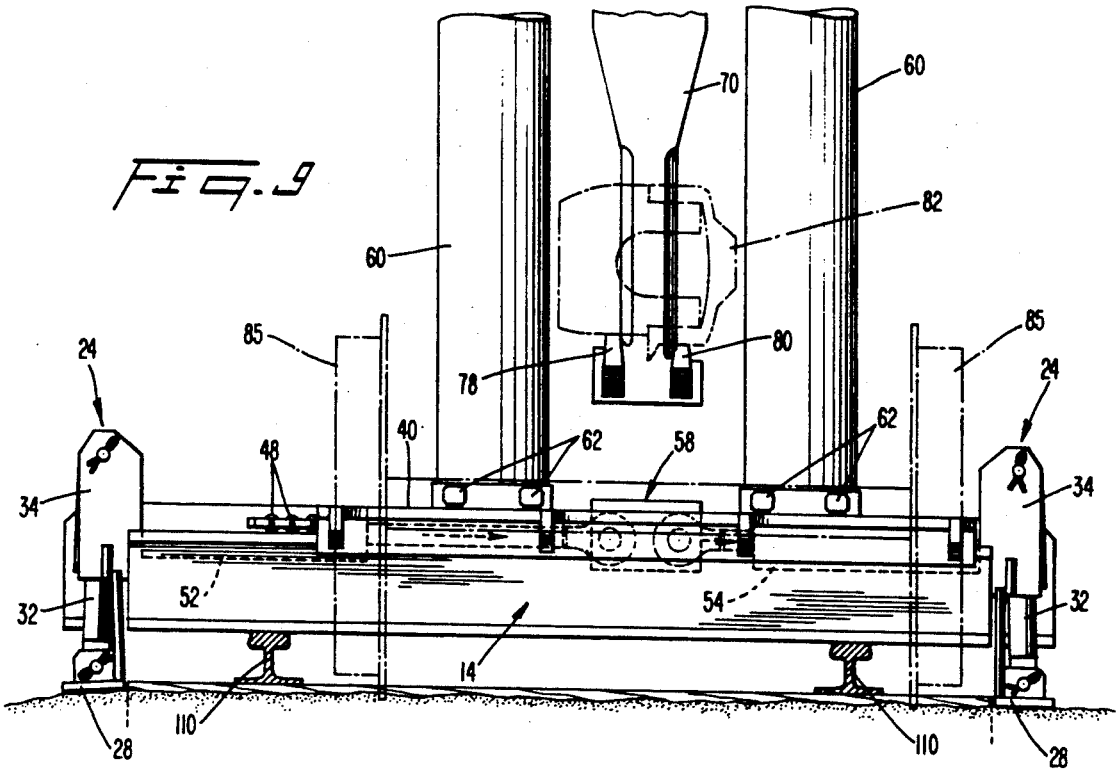
FIG. 9 is a front elevational view of the re-railing unit in the position depicted in FIG. 8, with the wheels of the rail car in phantom.

Once the re-railer 10 has been positioned in front of the de-railed end of the rail car 84 (see FIGS. 8 and 9), the vehicle can be detached from the re-railer if the re-railer contains its own source of pressurized hydraulic fluid as described earlier.

Otherwise, the hydraulic system of the vehicle would be connected to the control mechanism 100 of the re-railing unit 10.

The positioning of the re-railing unit in front of the de-railed end of the rail car is performed so that the hooks 78, 80 of the lifting arm are situated beneath the drawhead 82 of the rail car. The stabilizing rams 32 can be actuated, if necessary, to suitably incline the beam 14 relative to the drawhead. If the wheels 85 of the rail car are not spaced very far from the track rails 10, it may be possible to simply support the beam 14 upon the rails of the track 110.

Figure 10:
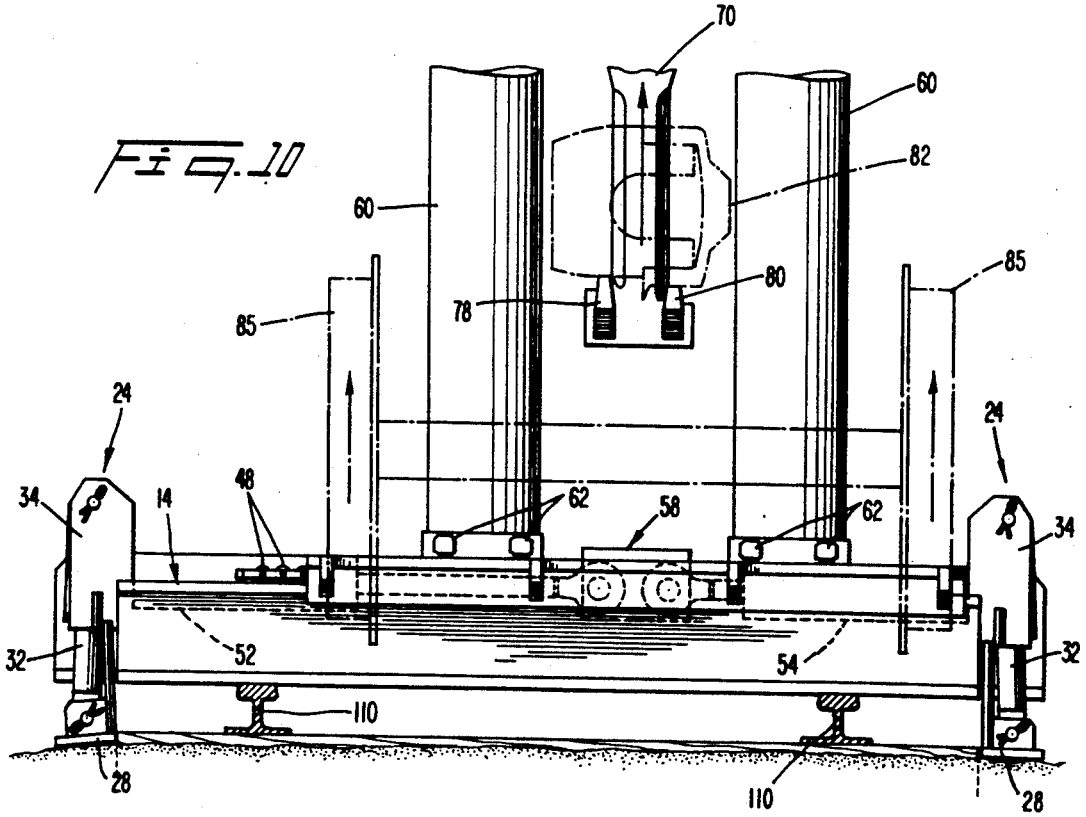
FIG. 10 is a view similar to FIG. 9 after the lifting arm has raised the wheels of the rail car.
Figure 11:
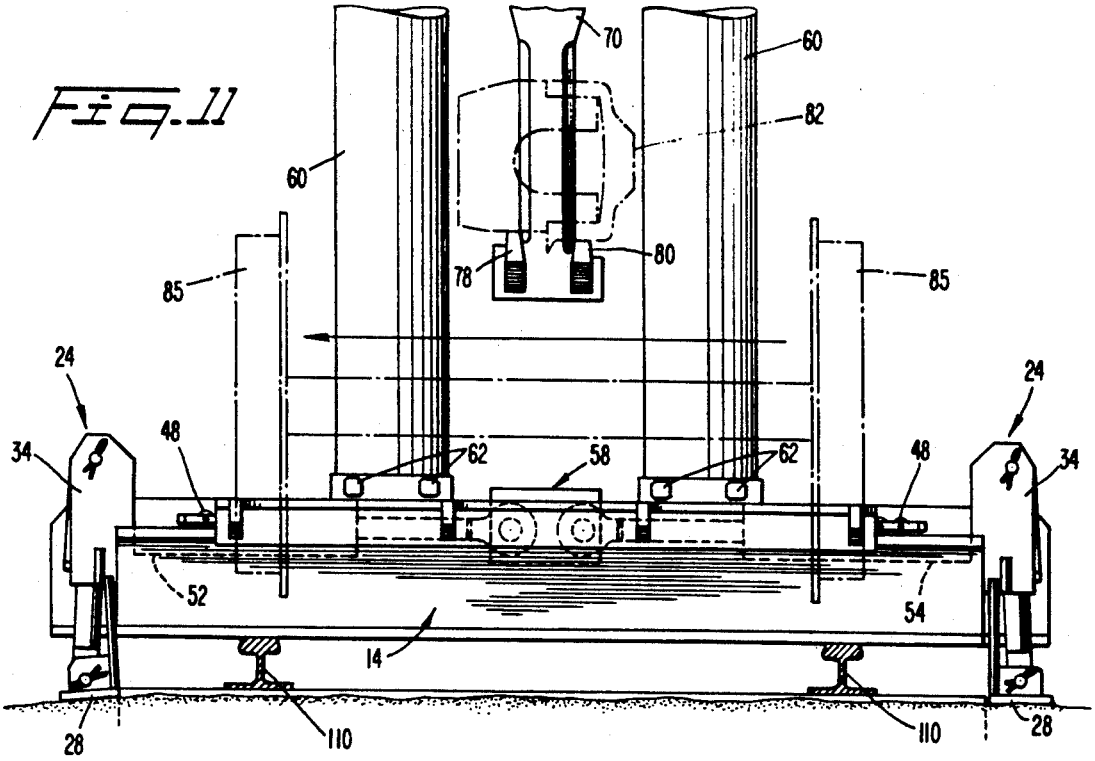
FIG. 11 is a view similar to FIG. 10 after the support plate of the re-railing unit has been horizontally displaced to position the rail car wheels over the rails of a track.
Figure 12:
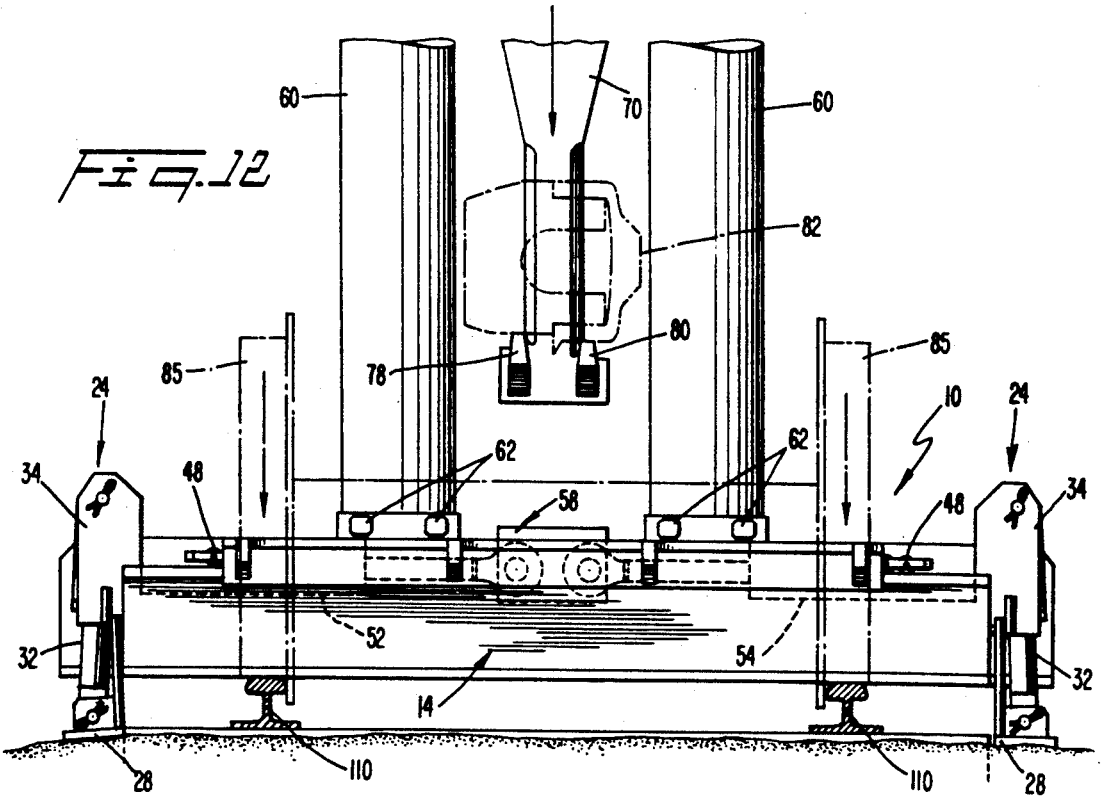
FIG. 12 is a view similar to FIG. 11 after the wheels have been lowered onto the track rails.

Thereafter, the lifter rams 60 are actuated to raise the lifter arm 70 which, in turn, raises the drawhead 82 and the de-railed wheels 85 of the rail car (FIG. 10). When the wheels 85 have been sufficiently raised, the shifter rams 52, 54 are actuated (i.e., the ram 54 is extended, and ram 52 is retracted) to slide the support plate 40 horizontally relative to the beam 14 (see FIG. 11). Traveling with the support plate 40 are the lifting rams 60, the lifting arm 70, and hence, the drawbar 82 and wheels 85 of the de-railed rail car. Once the de-railed wheels 85 of the rail car become disposed above the track rails 110 the sliding rams are deactivated and the pressure in the lifting rams 60 is relieved, to allow the lifting rams to descend, thereby bringing the wheels 85 into engagement with the track rails 110. A similar operation can be performed on the opposite end of the rail car, if necessary. Thereafter, the re-railing unit 10 is removed by the vehicle 12.

It will be appreciated that the re-railing unit according to the present invention is considerably simpler, smaller, and less expensive than a rail-mounted crane. The unit can be conveniently stored at sites where de-railings tend to occur, e.g., at a rail yard. Hence, the overall cost and time delay involved in re-railing a rail car can be markedly reduced.

It will also be appreciated by those skilled in the art that additions, modifications, substitutions, and deletions not specifically described may be made without departing from the spirit and scope of the invention as defined in the appended claims.

What is claimed is:

1. A re-railing unit for re-railing a de-railed rail car, comprising:

a base having longitudinally spaced ends and connecting arm means releasably connectible to a vehicle;

hydraulic ground support members carried adjacent respective ends of said base and including vertically adjustable means;

a support plate mounted on said base for longitudinal sliding movement thereon;

bearing means, including a plurality of rolling elements disposed between said support plate and said base;

a pair of upright hydraulic lifting rams extending upwardly from said support plate;

a lifting arm suspended at its upper end from said lifting rams and disposed between said lifting rams, a lower end of said lifting arm carrying hook means for engaging a drawhead of the de-railed rail car, said lifting arm and drawhead being raisable in response to extension of said lifting rams;

power actuated means connected between said base and said support plate for sliding said support plate longitudinally across said base to reposition wheels of the raised rail car over the track from which it has become de-railed so that the wheels can be lowered by said lifting rams.

2. A re-railer unit according to claim 1, wherein said rolling elements are rotatably mounted to a retainer, said retainer being freely displaceable between said support plate and said base.

3. A re-railer unit according to claim 1, wherein said base carries a valve mechanism for directing fluid to and from said hydraulic ground support members, said lifting rams, said power actuator means, and a source of pressurized hydraulic fluid.

4. A re-railer unit according to claim 3, wherein said base carries said source of pressurized hydraulic fluid.

5. A re-railer unit according to claim 1, wherein said power actuated means comprises at least one hydraulic shifting ram.

* * * * *